US006647913B2

(12) United States Patent
Brignolio

(10) Patent No.: US 6,647,913 B2
(45) Date of Patent: Nov. 18, 2003

(54) COLLAPSIBLE BOAT TRANSPORT SYSTEM

(76) Inventor: James C. Brignolio, 14755 S. Prescott Rd., Manteca, CA (US) 95336

( * ) Notice: Subject to any disclaimer, the term of this patent is extended or adjusted under 35 U.S.C. 154(b) by 33 days.

(21) Appl. No.: 10/034,162

(22) Filed: Dec. 26, 2001

(65) Prior Publication Data

US 2003/0116072 A1 Jun. 26, 2003

(51) Int. Cl.[7] ..... B63B 21/64

(52) U.S. Cl. ..... 114/344; 114/353; 114/354; 114/61.18

(58) Field of Search ..... 114/344, 353, 114/354, 61.15, 61.18, 45; 280/414.1, 414.2

(56) References Cited

U.S. PATENT DOCUMENTS

| | | | | | |
|---|---|---|---|---|---|
| 1,710,625 | A | * | 4/1929 | Kapigian | 114/123 |
| 2,108,747 | A | * | 2/1938 | Glover | 280/1 |
| 2,816,672 | A | * | 12/1957 | Facchini | 414/534 |
| 2,876,728 | A | | 3/1959 | Luger | |
| 2,992,444 | A | | 7/1961 | Schuler | |
| 3,058,756 | A | * | 10/1962 | Holsclaw | 280/414.1 |
| 3,630,163 | A | * | 12/1971 | Williams | 114/85 |
| 3,792,502 | A | * | 2/1974 | Odegaard | 114/344 |
| 3,913,934 | A | * | 10/1975 | Koehn et al. | 280/656 |
| 3,925,837 | A | | 12/1975 | Miller | |
| 3,978,536 | A | | 9/1976 | Howe | |
| 4,243,242 | A | * | 1/1981 | Waits | 280/414.1 |
| 4,327,933 | A | * | 5/1982 | Tuggle | 280/414.2 |
| 4,730,570 | A | * | 3/1988 | Harris | 114/61.18 |
| 4,801,153 | A | * | 1/1989 | Wilson | 280/414.1 |
| 4,909,169 | A | | 3/1990 | Skandaliaris et al. | |
| 5,517,940 | A | * | 5/1996 | Beyer | 114/354 |
| 5,518,261 | A | * | 5/1996 | Godbersen | 280/414.1 |
| 5,590,616 | A | * | 1/1997 | Vera | 114/61.16 |
| 5,823,559 | A | * | 10/1998 | Priesgen et al. | 280/414.1 |
| 6,003,458 | A | * | 12/1999 | Valliere | 114/61.18 |
| 6,178,913 | B1 | | 1/2001 | Brignolio | |
| 6,257,167 | B1 | * | 7/2001 | Joaquim | 114/344 |
| 6,298,802 | B1 | | 10/2001 | Brignolio | |

* cited by examiner

*Primary Examiner*—S. Joseph Morano
*Assistant Examiner*—Ajay Vasudeva
(74) *Attorney, Agent, or Firm*—Thomas R. Lampe

(57) ABSTRACT

A collapsible boat includes a center pontoon and two side pontoons which can be moved toward or away from one another and toward or away from the center pontoon. The center pontoon is fixed in position and is accommodated by a cradle fixed in position on a trailer. The trailer includes two movable cradles which accommodate the movable side pontoons of the collapsible boat so that the trailer can be widened or narrowed when the boat is widened or narrowed.

11 Claims, 8 Drawing Sheets

COLLAPSIBLE BOAT TRANSPORT SYSTEM

TECHNICAL FIELD

This invention relates to a collapsible boat and a transport vehicle for transporting the collapsible boat. More particularly, the collapsible boat incorporates relatively movable pontoons and the transport vehicle includes supports for the pontoons which are movable with the pontoons when the configuration of the collapsible boat changes between a wide boat configuration and a narrow boat configuration.

BACKGROUND OF THE INVENTION

My U.S. Pat. No. 6,178,913, issued Jan. 30, 2001, and my U.S. Pat. No. 6,298,802, issued Oct. 9, 2001, relate to collapsible boat structures, the latter patent also relating to a transport vehicle cooperable with the boat to support the boat when the boat changes configuration.

The following United States patents also disclose boat structures which can be collapsed to provide an alternate boat configuration: U.S. Pat. No. 3,925,837, issued Dec. 16, 1975, U.S. Pat. No. 2,876,728, issued Mar. 10, 1959, U.S. Pat. No. 4,909,169, issued Mar. 20, 1990, U.S. Pat. No. 3,978,536, issued Sep. 7, 1976, and U.S. Pat. No. 2,992,444, issued Jul. 18, 1961.

DISCLOSURE OF INVENTION

The invention disclosed and claimed herein includes a collapsible boat having a plurality of boat deck panels similar in construction to the boat deck panels shown in my prior patents indicated above. In common with the invention of U.S. Pat. No. 6,298,802 the present invention incorporates a transport vehicle for the boat and cooperable therewith to support the boat while the boat is in wide and narrow configurations and also while the boat changes between the configurations. However, the present system is directed to a three pontoon boat and incorporates a combination of structural elements which cooperate in a unique manner to move two side pontoons of the boat relative to each other and relative to a fixed center pontoon during expansion or contraction of the boat.

The invention is directed to a combination including a collapsible boat having alternative first and second configurations, said collapsible boat being wider in said first configuration than in said second configuration. The collapsible boat has a boat deck and includes a center pontoon, a first side pontoon and a second side pontoon, said center pontoon, said first side pontoon and said second side pontoon being located below said boat deck with said first side pontoon and said second side pontoon disposed on opposed sides of said center pontoon.

The first side pontoon and the second side pontoon are selectively movable toward or away from one another and toward or away from the center pontoon, said first and second pontoons being further apart from each other and from said center pontoon when said collapsible boat is in said first configuration than when said collapsible boat is in said second configuration.

A transport vehicle receives the collapsible boat for supporting and transporting said collapsible boat on land when said collapsible boat is not afloat, said collapsible boat being completely separable from said transport vehicle whereby said collapsible boat may be placed afloat completely separate from said transport vehicle. The transport vehicle includes movable first and second pontoon supports for respectively removably receiving, accommodating and supporting said first side pontoon and said second side pontoon when said transport vehicle supports said collapsible boat and additionally includes a fixed third pontoon support for removably receiving, accommodating and supporting said center pontoon when said transport vehicle supports said collapsible boat.

The combination also incorporates mover means for selectively causing movement of said first side pontoon and said second side pontoon toward or away from each other and toward and away from said central pontoon and for substantially simultaneously selectively changing the configuration of said boat to either said first configuration or said second configuration.

BEST MODE FOR CARRYING OUT THE INVENTION

Figure 1:
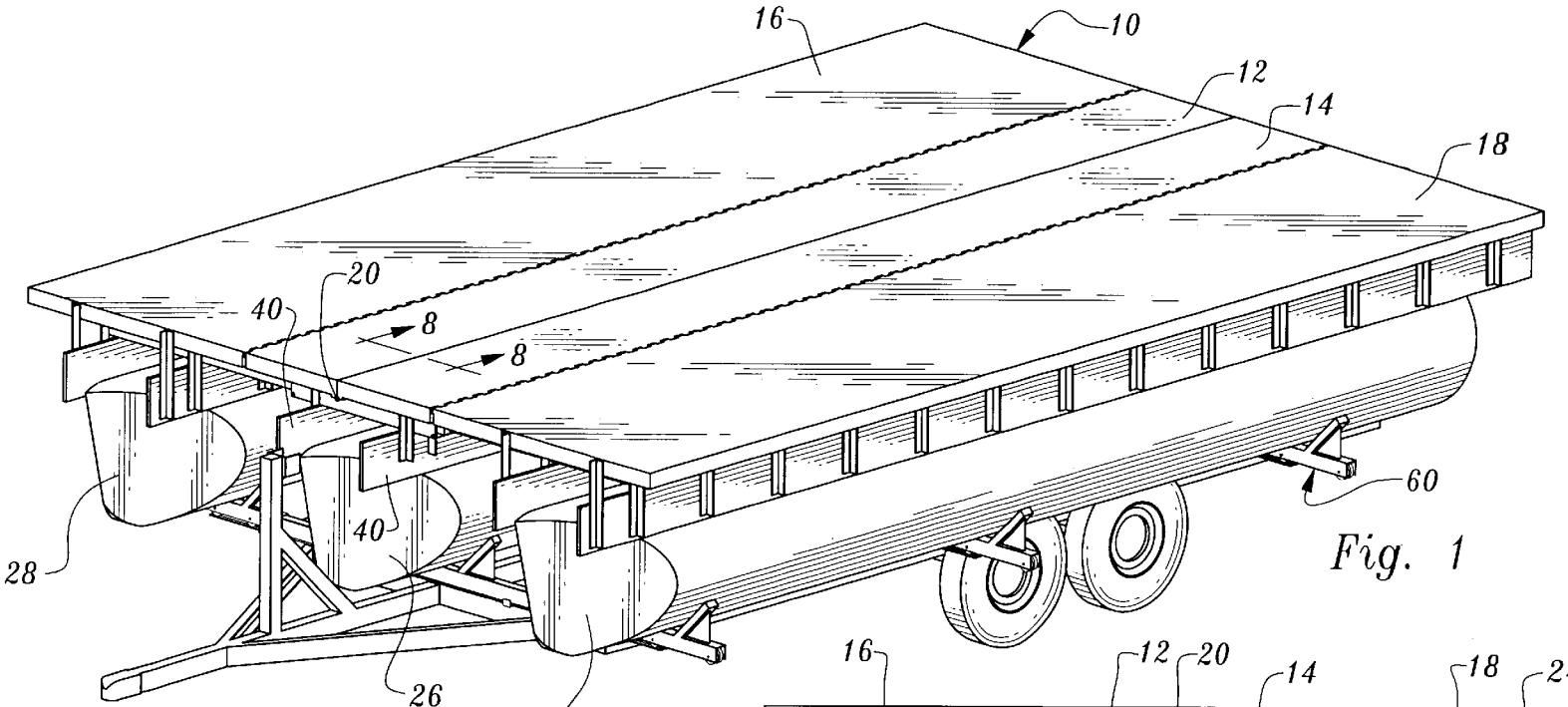
FIG. 1 is a perspective view of a collapsible boat supported by a transport vehicle constructed in accordance with the teachings of the present invention, the collapsible boat being shown in non-collapsed condition.

Referring now to the drawings, a collapsible boat 10 is illustrated.

Figure 2:
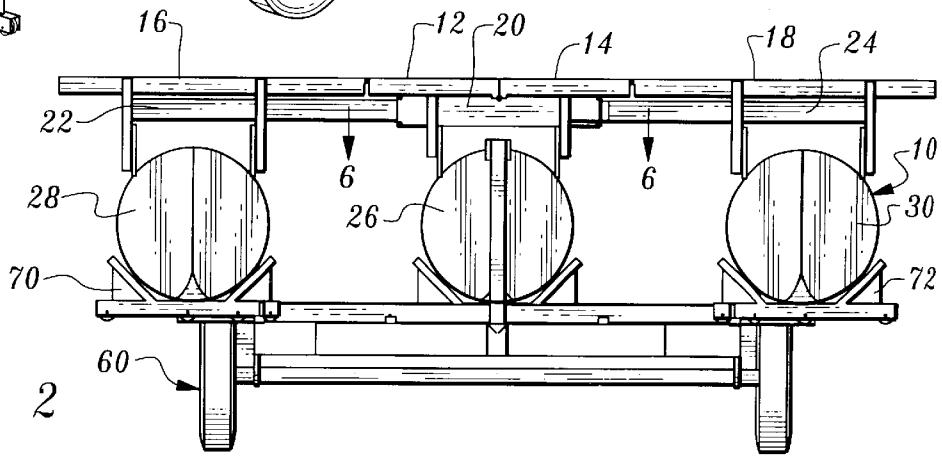
FIG. 2 is an end elevational view of the transport vehicle and non-collapsed boat.
Figure 3:
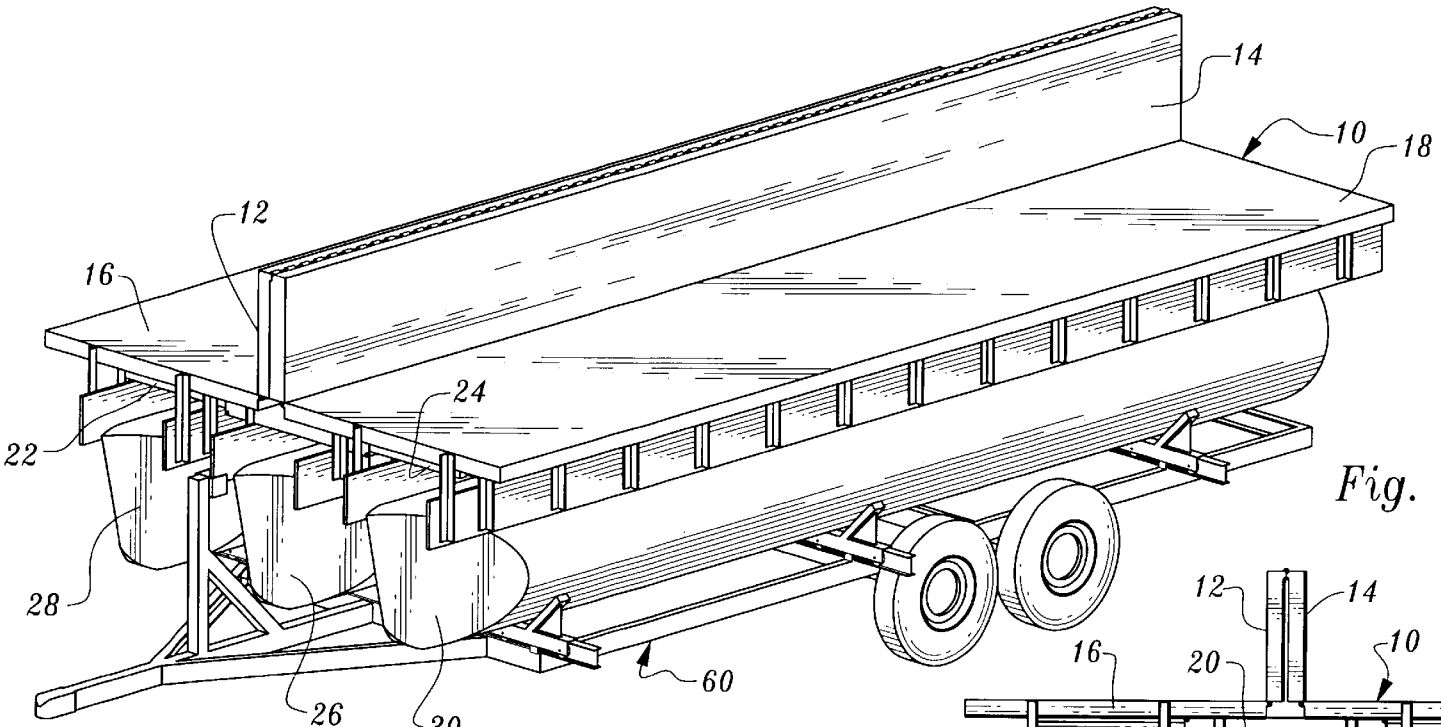
FIG. 3 is a view similar to FIG. 1 but illustrating the boat in collapsed condition on the transport vehicle, the boat having a reduced width in the collapsed condition.
Figure 4:
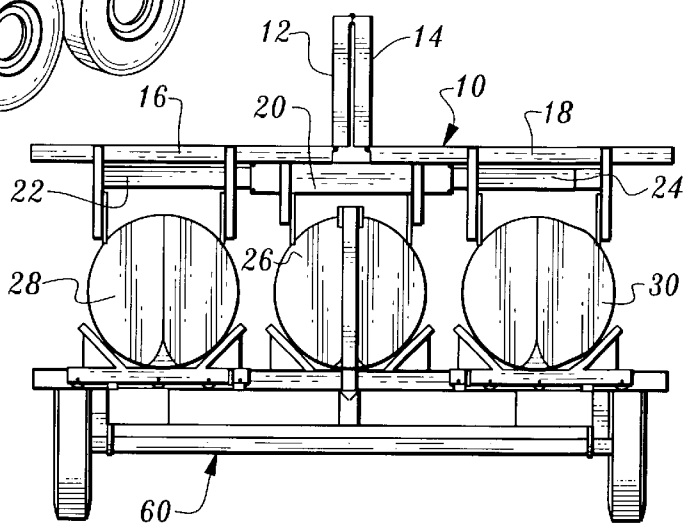
FIG. 4 is a view similar to FIG. 2 with the transport vehicle supporting the collapsed boat.

Boat 10 has first and second alternative configurations, the boat being wider in the first configuration thereof (shown in FIGS. 1 and 2, for example) than in the second configuration thereof (shown in FIGS. 3 and 4, for example).

The boat 10 includes a boat deck having center deck panels 12, 14 disposed side-by-side and outer deck panels 16, 18. Outer deck panel 16 is disposed alongside center deck panel 12, the center deck panel 12 located between the center deck panel 14 and outer deck panel 16. Outer deck panel 18 is disposed alongside the center deck panel 14, the center deck panel 14 positioned between the center deck panel 12 and the outer deck panel 18. The deck panels suitably include solid top portions over open framework portions.

Figure 10:
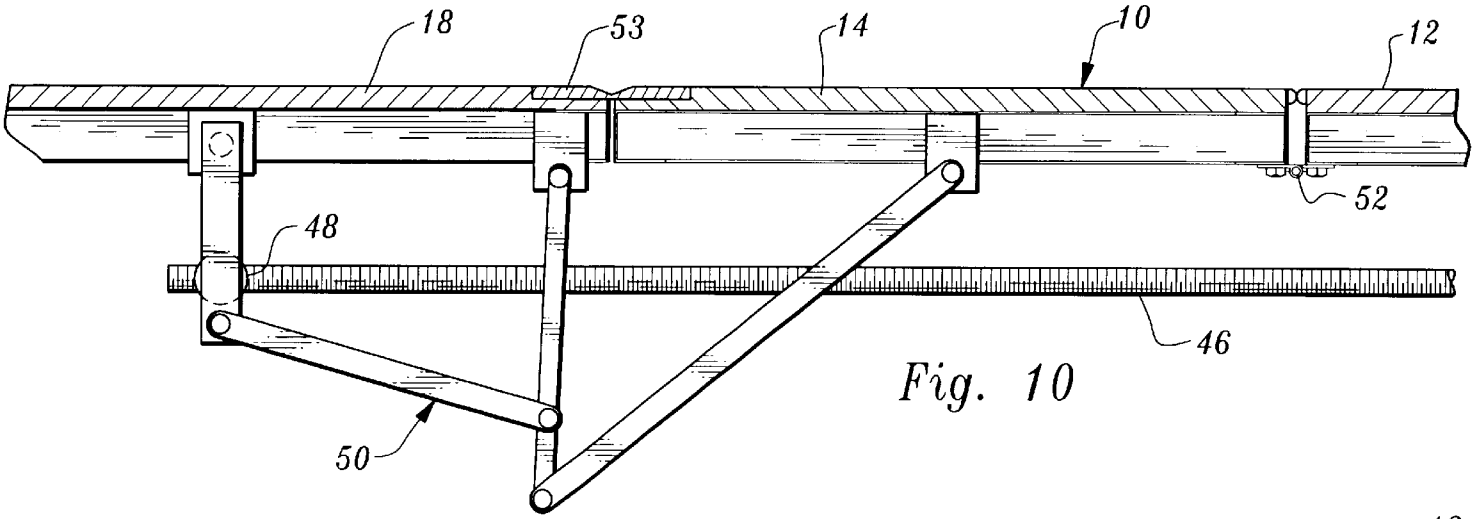
FIGS. 10–13 are sectional, elevational views showing portions of center deck panels of the boat along with mechanical linkage operatively associated therewith, the illustrated components being shown in the sequential relative positions assumed thereby as the center deck panels move from a horizontal to vertical orientation.
Figure 11:
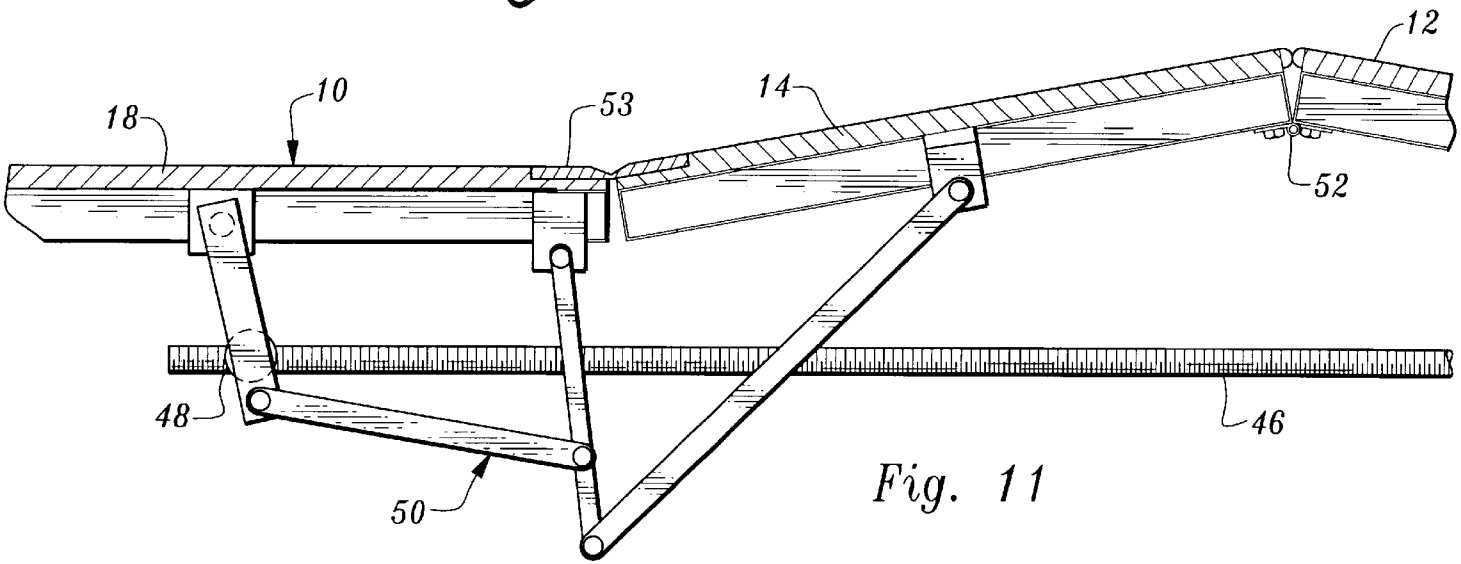
Figure 12:
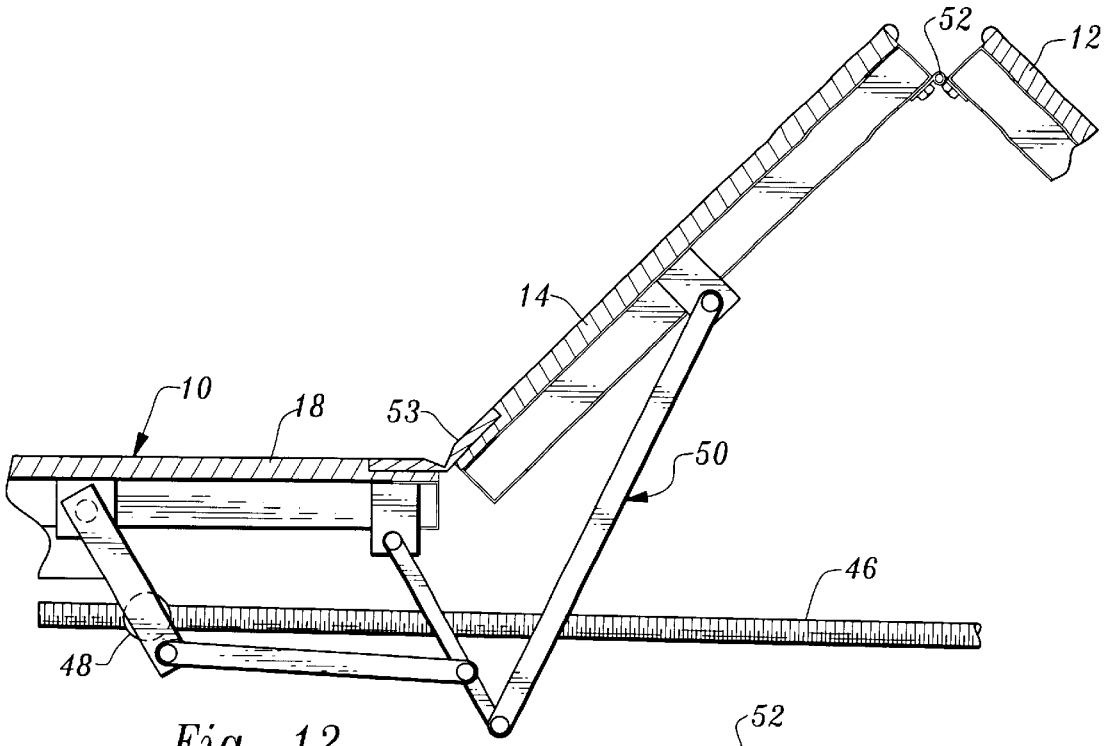
Figure 13:
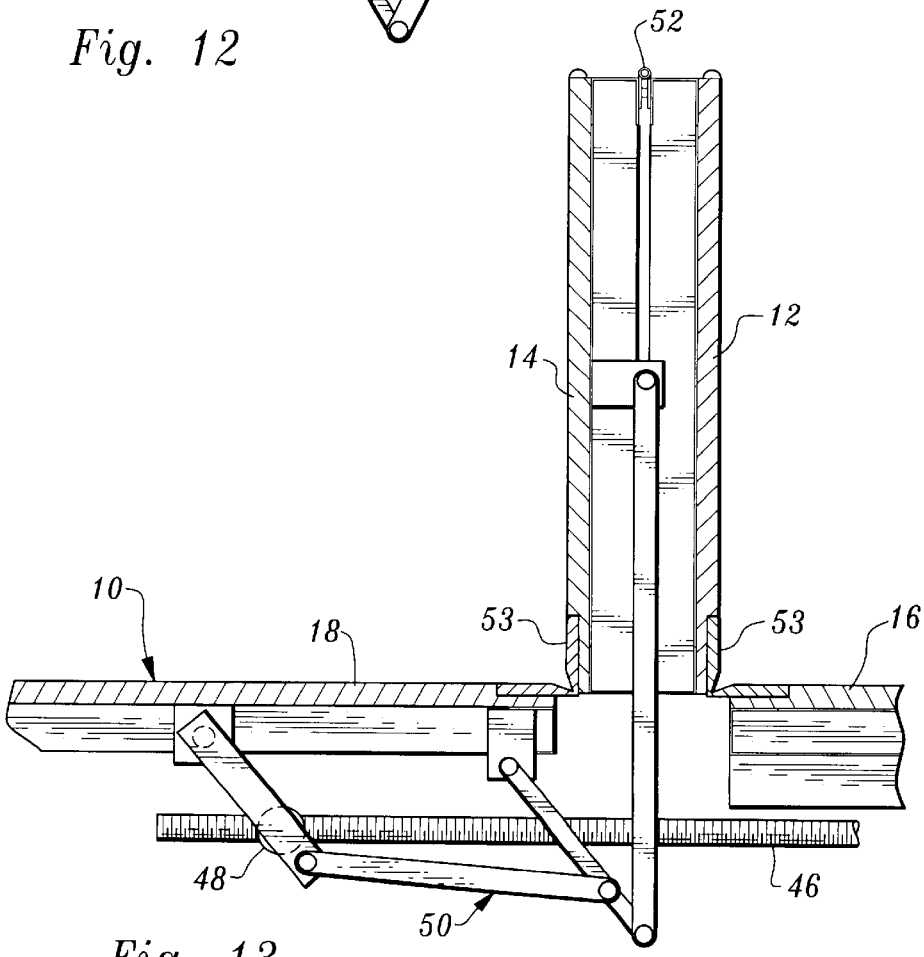
Figure 14:
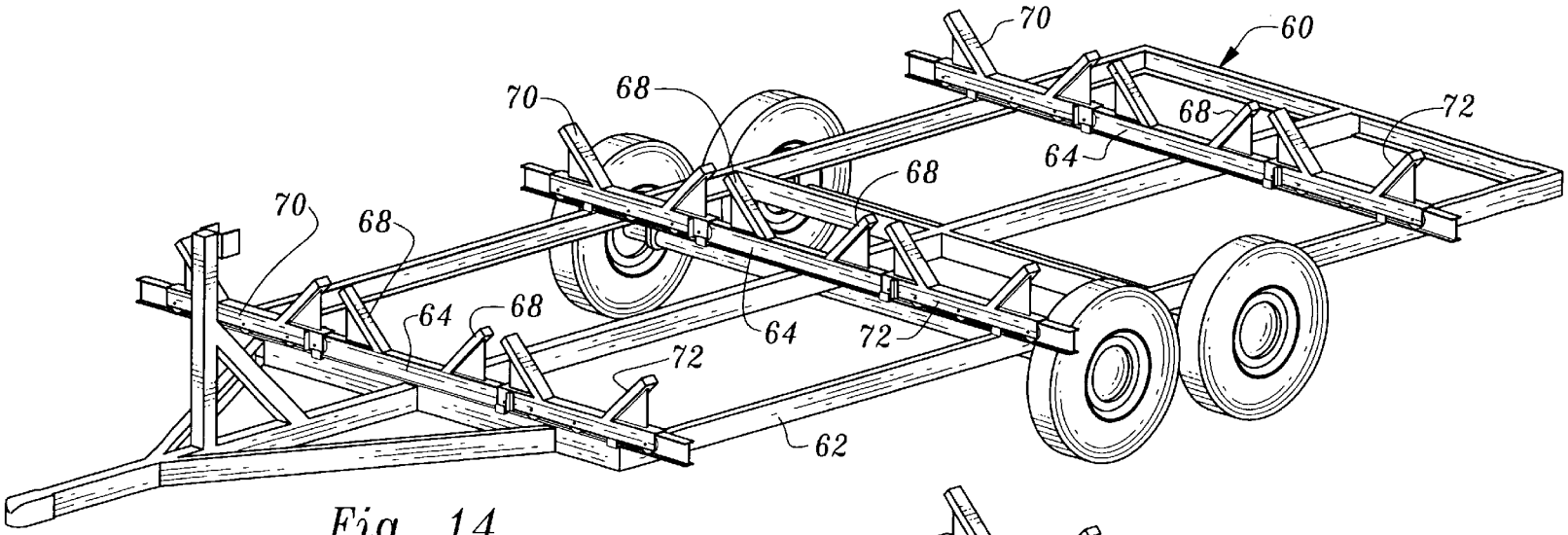
FIGS. 14 and 15 are top, perspective views respectively illustrating the transport vehicle in contracted and expanded condition.
Figure 15:
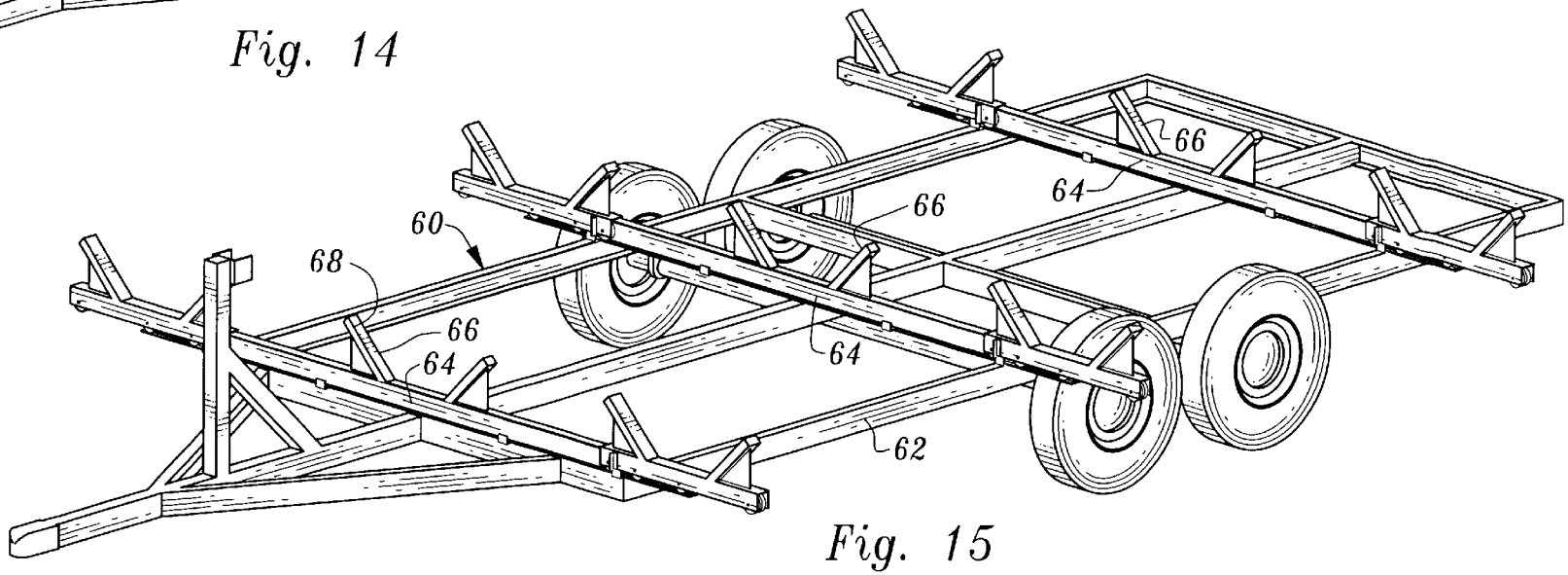
Figure 16:
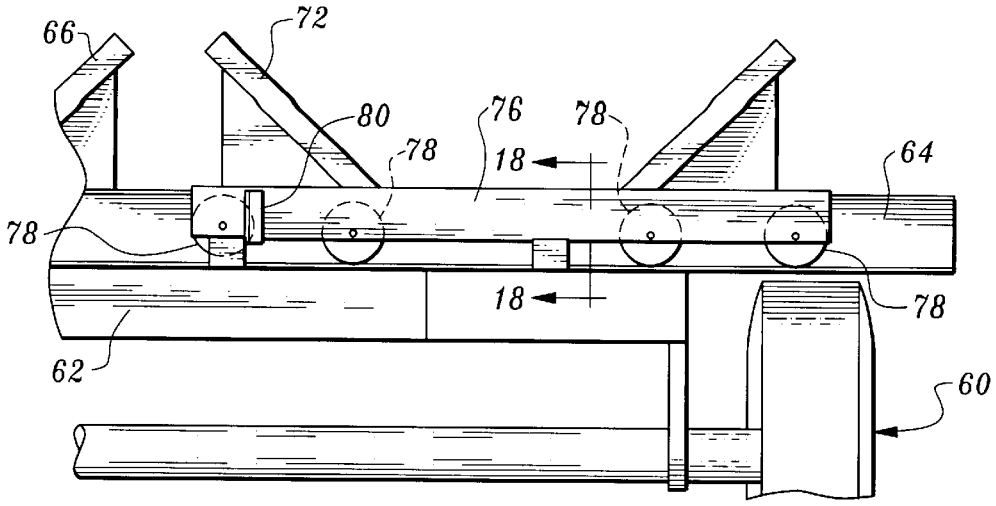
FIGS. 16 and 17 are enlarged, elevational views showing the relative positions assumed by selected components of the transport vehicle when the transport vehicle is respectively in contracted and expanded condition.
Figure 17:
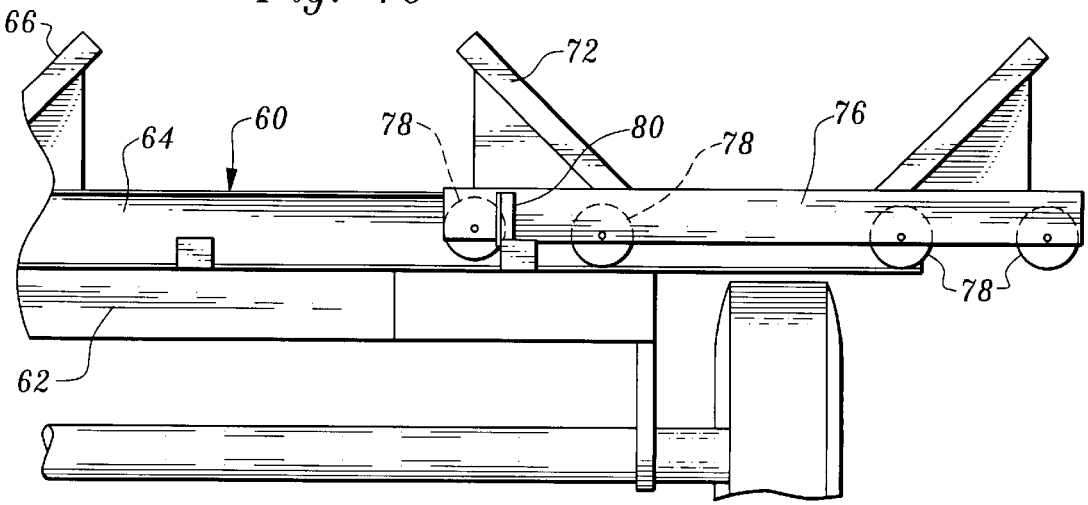
Figure 18:
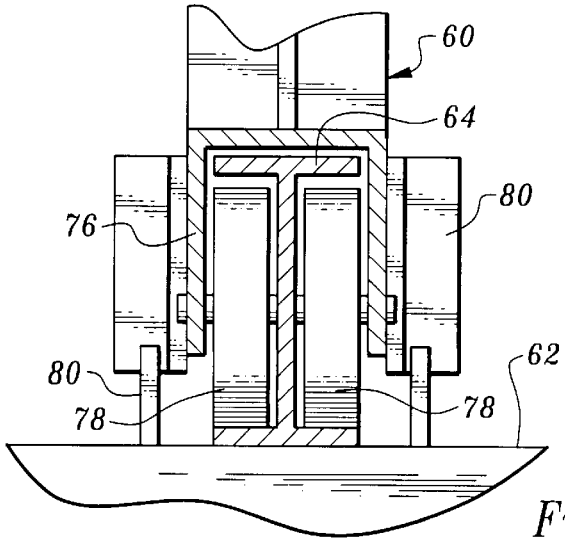
FIG. 18 is a greatly enlarged, cross-sectional view taken along line 18—18 in FIG. 16.

When the boat is in non-collapsed condition for use as a boat, the panels 12, 14, 16 and 18 are all oriented horizontally and are in the same plane. They can be seen in this condition in FIGS. 1, 2 and 10 for example. When, however, the boat is to be collapsed for storage or transport, the center deck panels are moved from a horizontal orientation to a vertical orientation as shown in FIGS. 3, 4 and 13, for example.

Supporting the deck panels 12, 14 are central support portions 20 of three spaced boat deck supports. Side support portions 22, 24 thereof respectively support panels 16 and 18.

A center pontoon 26 is affixed to and extends downwardly from the central support portions 20 of the boat deck supports. On the other hand, side pontoons 28, 30 are attached to and depend from the side support portions 22, 24, respectively. Since the three boat deck supports employed in the collapsible boat structure are identical, only one such boat deck support will be described in detail.

Figure 6:
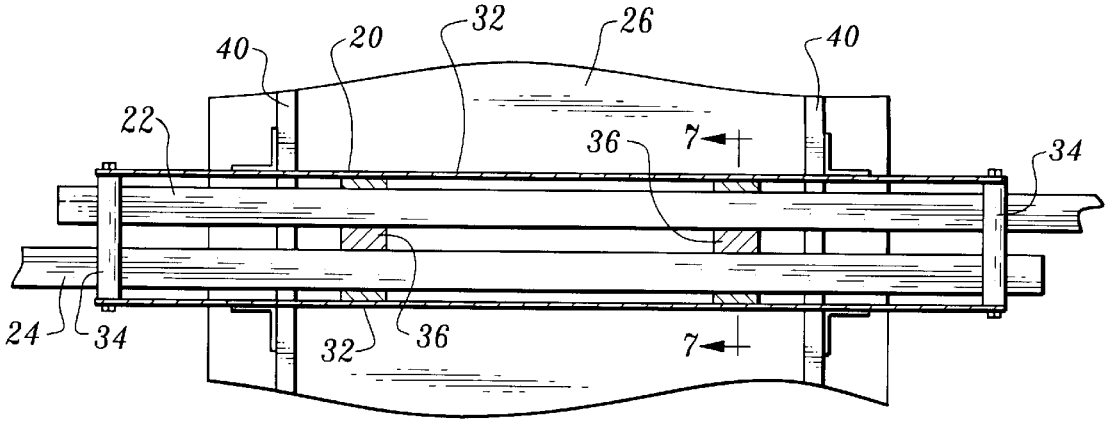
FIG. 6 is an enlarged, partial sectional view taken along line 6—6 in FIG. 2.
Figure 7:
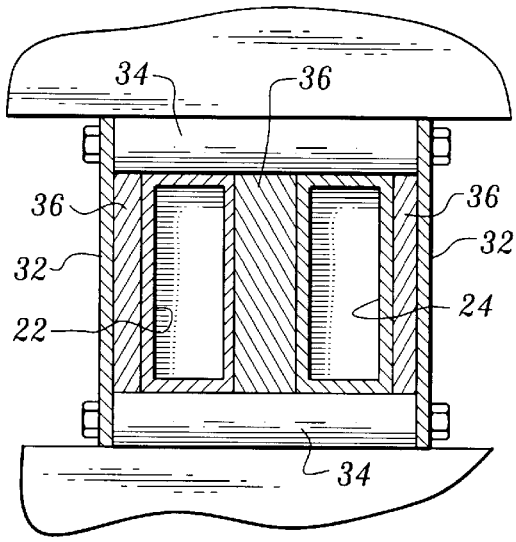
FIG. 7 is a greatly enlarged cross-sectional view taken along the line 7—7 in FIG. 6.

With particular reference to FIGS. 6 and 7, central support portion 20 is illustrated as being in the form of a housing formed by two spaced side plates 32 extending parallel to one another above center pontoon 26. Upper and lower rollers 34 are located at the ends of the plates and extend therebetween. Side support 22 comprises a rectangular-shaped channel member extending between the upper and lower rollers and partially into the interior of the central support portion defined by the side plates 32. Side support portion 24 is of the same construction as side support portion 22 and extends between the side plates 32 parallel to side support portion 22. The side support portions 22, 24 are separated by suitable spacers 36 made out of tetrafluoroethylene for example. The side plates 32 are affixed to the pontoon 26 by structural elements including connector plates 40. Similar connector plates are employed to attach the pontoons 28, 30 to the side support portions associated therewith. An important distinction exists, however, in that the connector plates associated with the side pontoons 28, 30 extend and are attached to the respective outer deck panels. This is to be distinguished from the connector plates 40 associated with center pontoon 26 which are not affixed to the center deck panels 12, 14 but merely provide support therefor when the center deck panels 12, 14 are horizontally disposed.

It may be seen from the above that the slidable interconnection between the central support portion 20 and the side support portions 22, 24 enables the side support portions to selectively either be moved toward one another and toward the central support portion or away from one another and away from the central support portion.

Relative movement of the outer deck panels 16, 18 is effected by a jack screw 44 which may be suitably powered, the jack screw having a selectively retractable or extendable elongated screw member 46 associated therewith.

Figure 5:
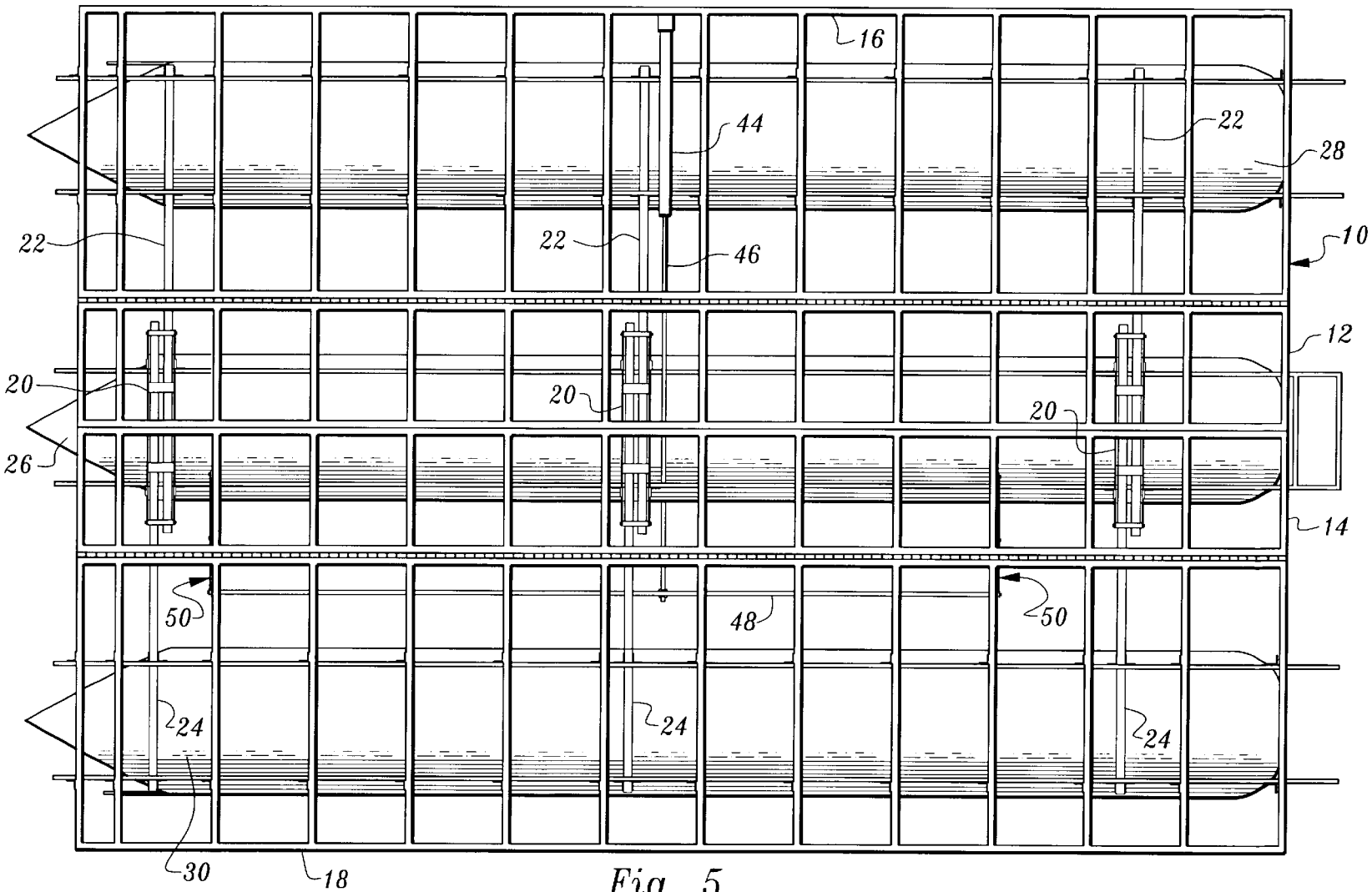
FIG. 5 is a top plan view of the boat in non-collapsed condition, only the open framework of the deck panels of the deck being illustrated so that other boat structure associated therewith is shown.

As may perhaps best be seen with reference to FIG. 5, wherein the upper solid portion of the boat deck has been removed, leaving only the lower deck open framework, jack screw 44 is attached to outer deck panel 16 while the distal end of the elongated screw member 46 is attached to outer deck panel 18 by a mechanical linkage including a connector rod 48 extending a substantial length along outer deck panel 18.

Also incorporated in the mechanical linkage are a plurality of sets of link arms generally designated by reference numeral 50. The link arms of each set thereof are pivotally interconnected to one another and located along connector rod 48. FIGS. 10–13 illustrate these link arms in detail.

FIGS. 10–13 show sequentially what happens when the elongated screw member 46 is retracted to pull the outer deck panels 16, 18 toward one another. The linkage 50 associated with and interconnecting center deck panel 14 and outer deck panel 18 will cause the center deck panel 14 to gradually be raised to a vertical orientation as shown in FIG. 13. A hinge 52 interconnects the center deck panels 12, 14 so that deck panel 12 also moves to a vertical orientation alongside center deck panel 14. The center deck panels 12, 14 are hingedly connected to their respective outer deck panels by hinges 53 to allow pivotal movement between the center deck panels and the outer deck panels. When the center deck panels 12, 14 are vertically disposed they project upwardly from center pontoon 26 and from the central support portions of the boat deck supports.

Figure 8:
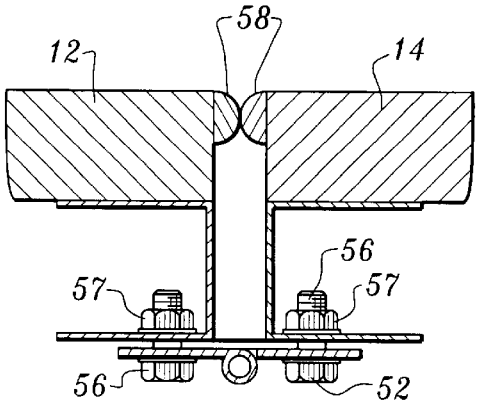
FIG. 8 is a greatly enlarged cross-sectional view taken along line 8—8 in FIG. 1 and showing portions of center deck panels and hinge structure associated therewith.
Figure 9:
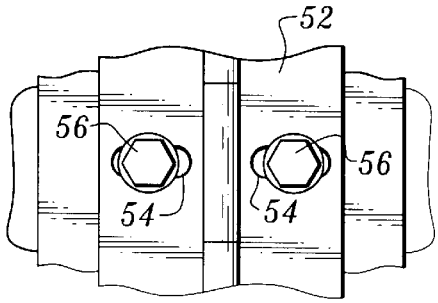
FIG. 9 is an enlarged bottom view of the hinge structure interconnecting the center deck panels.

As may perhaps best be-seen with reference to FIGS. 8 and 9, the hinge 52 has slots 54 formed therein which accommodate bolts 56 providing the interconnection between the hinge and the center deck panels 12, 14. The slots allow some relative movement between the hinge and the center deck panels, the locking nuts 57 associated with the bolts not being tightened to a degree that would impair such relative movement. Spacers 58 are located at the adjacent distal ends of the center deck panels to maintain a space therebetween. This arrangement allows the ends of the center deck panels to clear one another when moving from a horizontal orientation to a vertical orientation so that binding which might otherwise interfere with the operation will not take place. When the screw jack 49 is actuated to retract the elongated screw member 46 and the center deck panels are in a horizontal orientation, the above-described linkage 50 first applies an upward force to the two center panels and the free ends are raised a relatively small distance until the bases of the center panels make contact, occupying the space between the center panels created by the spacers. This results from the ability of the center panels to move relative to the hinge 52. Until base contact between the center panels takes place, there is no movement of the outer deck panels toward one another. Once however center panel base contact takes place, the outer deck panels are pulled toward one another and movement of the center deck panels to a vertical orientation is completed.

Outward movement of the pontoons 28, 30 and return of the center deck panels to a horizontal orientation is readily accomplished by actuating the screw jack 44 to extend elongated screw member 46.

The system of the present invention includes a transport vehicle 60 which in the illustrated embodiment is a trailer. Trailer 60 is for supporting and transporting collapsible boat 10 on land. The collapsible boat is completely separable from the trailer whereby the boat may be placed afloat completely separate from the trailer.

Trailer 60 includes a wheeled frame 62 including three structural cross channels or trackways 64 in the nature of I beams fixed in position relative to the rest of the frame.

Affixed to and projecting upwardly from the centers of the cross channels are pontoon cradles 66. Each cradle 66 is formed by two diverging cradle elements 68. The cradles 66 define recesses which accommodate the center pontoon 26 of the boat.

Trailer 60 also includes pontoon supports 70, 72 also in the form of cradles. Cradles 70, 72 accommodate side pontoons 28, 30, respectively, therein. Each of the cradles 70, 72 includes not only the diverging cradle elements but also a base element 76 from which the diverging cradle elements extend having wheels 78 rotatably mounted thereon. Wheels 78 are located in opposed recesses of the cross channels 64.

From the above, it will be seen that the cradles 70, 72 are free to move toward or away from the fixed central cradle 66. Stops 80 are employed to limit movement of the cradles 70, 72 relative to the trailer frame.

Widening of the trailer 60 will allow the trailer to accommodate the boat 10 when the boat is in its wide configuration. Similarly, the cradles of the trailer can be moved to narrow the trailer to accommodate the boat when it is in narrow condition. When the boat carried by the trailer is changed between the two configurations, the trailer cradles will readily allow this and adapt the configuration of the trailer to that of the boat.

In this arrangement, the fixed central cradle 66 and the fixed center pontoon cooperate to maintain a highly stable relationship between the trailer and boat supported thereby, even during widening or contracting of the combined trailer and boat. Forces exerted during these activities are focused on and are resolved at the location of the most stable structural components of the combined boat and trailer.

The invention claimed is:

1. In combination:

a collapsible boat having alternative first and second configurations, said collapsible boat being wider in said first configuration than in said second configuration, said collapsible boat having a boat deck and including a center pontoon, a first side pontoon and a second side pontoon, said center pontoon, said first side pontoon and said second side pontoon being located below said boat deck with said first side pontoon and said second side pontoon disposed on opposed sides of said center pontoon, said first side pontoon and said second side pontoon being selectively movable toward or away from one another and toward or away from said center pontoon, said first and second side pontoons being further from each other and from said center pontoon when said collapsible boat is in said first configuration than when said collapsible boat is in said second configuration;

a transport vehicle for receiving said collapsible boat and for supporting and transporting said collapsible boat on land when said collapsible boat is not afloat, said collapsible boat being complete separable from said transport vehicle whereby said collapsible boat may be placed afloat completely separate from said transport vehicle, said transport vehicle including a transport vehicle frame and movable first and second pontoon supports freely slidable on said transport vehicle frame alternatively toward or away from one another for respectively removably receiving, accommodating and supporting said first side pontoon and said second side pontoon when said transport vehicle supports said collapsible boat and additionally including a third pontoon support fixedly attached to said transport vehicle frame between said first pontoon support and said second pontoon support for removably receiving, accommodating and supporting said center pontoon when said transport vehicle supports said collapsible boat to maintain said center pontoon in fixed position relative to said transport vehicle frame; and mover means on said collapsible boat for selectively causing movement of said first side pontoon and said second side pontoon toward or away from each other and toward and away from said central pontoon and for substantially simultaneously selectively changing the configuration of said boat to either said first configuration or said second configuration, movement of said first side pontoon and said second side pontoon by said mover means causing slidable corresponding movement of said first and second pontoon supports on said transport vehicle frame when said transport vehicle supports said collapsible boat.

2. The combination according to claim 1 wherein said collapsible boat includes a boat deck support disposed below said boat deck, said boat deck support including a central support portion and side support portions, said side support portions moving toward said central support portion when said collapsible boat moves from said first configuration to said second configuration, said center pontoon being fixedly connected to said central support portion and said first side pontoon and said second side pontoon being connected to and movable with said side support portions.

3. The combination according to claim 2 wherein said boat deck includes first and second center deck panels disposed side-by-side and first and second outer deck panels, said first outer deck panel being disposed alongside said first center deck panel and said first center deck panel being positioned between said second center deck panel and said first outer deck panel, said second outer deck panel being disposed alongside said second center deck panel and said second center deck panel being positioned between said first center deck panel and said second outer deck panel, said first and second center deck panels moving from a substantially horizontal orientation to a substantially vertical orientation when said mover means changes the configuration of said collapsible boat from said first configuration to said second configuration, said first and second center deck panels when in said substantially vertical orientation being disposed above and projecting upwardly away from said central support portion and said center pontoon.

4. The combination according to claim 3 wherein said mover means includes a jack screw having a selectively retractable or extendable elongated screw member connected thereto, said jack screw being attached to one of said first and second outer deck panels and said elongated screw member extending from said jack screw and attached to the other of said first and second outer deck panels.

5. The combination according to claim 4 wherein said mover means additionally includes mechanical linkage interconnecting at least one of said first and second outer deck panels to an adjacent one of said first and second center deck panels for pivoting the interconnected outer and center deck panels upon retraction of said elongated screw member and movement of said first outer deck panel and said second outer deck panel toward one another.

6. The combination according to claim 1 wherein said first, second and third pontoon supports comprise cradles defining recesses receiving the first side pontoon, the second side pontoon and the center pontoon.

7. A collapsible boat having alternative first and second configurations, said collapsible boat being wider in said first configuration than in said second configuration, said collapsible boat having a boat deck and including a center pontoon, a first side pontoon and a second side pontoon, said center pontoon, said first side pontoon and said second side pontoon being located below said boat deck with said first side pontoon and said second side pontoon disposed on opposed sides of said center pontoon, said first side pontoon and said second side pontoon being selectively movable toward or away from one another and toward or away from said center pontoon, said first and second side pontoons being further apart from each other and from said center pontoon when said collapsible boat is in said first configuration than when said collapsible boat is in said second configuration, said collapsible boat including a boat deck support disposed below said boat deck, said boat deck support including a central support portion and side support portions, said side support portions moving toward said central support portion when said collapsible boat moves from said first configuration to said second configuration, said center pontoon being fixedly connected to said central support portion and said first side pontoon and said second side pontoon being connected to and movable with said side support portions, said boat deck including first and second center deck panels disposed side-by-side and first and second outer deck panels, said first outer deck panel being disposed alongside said first center deck panel and said first center deck panel being positioned between said second center deck panel and said first outer deck panel, said second outer deck panel being disposed alongside said second center deck panel and said second center deck panel being positioned between said first center deck panel and said second outer deck panel, said first and second center deck panels moving from a substantially horizontal orientation to a substantially vertical orientation when the configuration of said collapsible boat changes from said first configuration, said first and second center deck panels when in said substantially vertical orientation being disposed above and prolecting upwardly away from said central support portion and said center pontoon.

8. A transport trailer for receiving, supporting and transporting a collapsible boat having alternative first and second configurations, said collapsible boat being wider in said first configuration than in said second configuration, said collapsible boat having a boat deck and including a center pontoon, a first side pontoon and a second side pontoon, said center pontoon, said first side pontoon and said second side pontoon being located below said boat deck with said first side pontoon and said second side pontoon disposed on opposed sides of said center pontoon, said first side pontoon and said second side pontoon being selectively movable toward or away from one another and toward or away from said center pontoon, said first and second pontoons being further apart from each other and from said center pontoon when said collapsible boat is in said first configuration than when said collapsible boat is in said second configuration, said transport trailer including a transport trailer frame and movable first and second pontoon supports freely slidable on said transport trailer frame alternatively toward or away from one another for respectively removably receiving, accommodating and supporting said first side pontoon and said second side pontoon when said transport trailer supports said collapsible boat and additionally including a third pontoon support fixedly attached to said transport trailer frame between said first pontoon support and said second pontoon support for removably receiving, accommodating and supporting said center pontoon when said transport trailer supports said collapsible boat to maintain said center pontoon in fixed position relative to said transport trailer frames, wherein each said first, second and third pontoon supports comprising cradles with spaced, diverging pontoon engagement surfaces defining recesses for non-rotatably receiving the first side pontoon, the second side pontoon and the center pontoon of the collapsible boat.

9. In combination:

a collapsible boat having alternative first and second configurations, said collapsible boat being wider in said first configuration than in said second configuration, said collapsible boat having a boat deck and including a center pontoon, a first side pontoon and a second side pontoon, said center pontoon, said first side pontoon and said second side pontoon being located below said boat deck with said first side pontoon and said second side pontoon disposed on opposed sides of said center pontoon, said first side pontoon and said second side pontoon being selectively movable toward or away from one another and toward or away from said center pontoon, said first and second side pontoons being further from each other and from said center pontoon when said collapsible boat is in said first configuration than when said collapsible boat is in said second configuration;

a transport vehicle for receiving said collapsible boat and for supporting and transporting said collapsible boat on land when said collapsible boat is not afloat, said collapsible boat being complete separable from said transport vehicle whereby said collapsible boat may be placed afloat completely separate from said transport vehicle, said transport vehicle including movable first and second pontoon supports for respectively removably receiving, accommodating and supporting said first side pontoon and said second side pontoon when said transport vehicle supports said collapsible boat and additionally including a third pontoon support for removably receiving, accommodating and supporting said center pontoon when said transport vehicle supports said collapsible boat; and mover means for selectively causing movement of said first side pontoon and said second side pontoon toward or away from each other and toward and away from said central pontoon and for substantially simultaneously selectively changing the configuration of said boat to either said first configuration or said second configuration, said collapsible boat including a boat deck support disposed below said boat deck, said boat deck support including a central support portion and side support portions, said side support portions moving toward said central support portion when said collapsible boat moves from said first configuration to said second configuration, said center pontoon being fixedly connected to said central support portion and said first side pontoon and said second side pontoon being connected to and movable with said side support portions, said boat deck including first and second center deck panels disposed side-by-side and first and second outer deck panels, said first outer deck panel being disposed alongside said first center deck panel and said first center deck panel being positioned between said second center deck panel and said first outer deck panel, said second outer deck panel being disposed alongside said second center deck panel and said second center deck panel being positioned between said first center deck panel and said second outer deck panel, said first and second center deck panels moving from a substantially horizontal orientation to a substantially vertical orientation when said mover means changes the configuration of said collapsible boat from said first configuration to said second configuration, said first and second center deck panels when in said substantially vertical orientation being disposed above and projecting upwardly away from said central support portion and said center pontoon.

10. The combination according to claim 9 wherein said mover means includes a jack screw having a selectively retractable or extendable elongated screw member connected thereto, said jack screw being attached to one of said first and second outer deck panels and said elongated screw member extending from said jack screw and attached to the other of said first and second outer deck panels.

11. The combination according to claim 10 wherein said mover means additionally includes mechanical linkage interconnecting at least one of said first and second outer deck panels to an adjacent one of said first and second center deck panels for pivoting the interconnected outer and center deck panels upon retraction of said elongated screw member and movement of said first outer deck panel and said second outer deck panel toward one another.

* * * * *